US005535518A

United States Patent [19]

Althaus

[11] Patent Number: 5,535,518

[45] Date of Patent: Jul. 16, 1996

[54] UNIQUE TWO-AXIS PIVOTING SHAVING SYSTEM

[75] Inventor: Wolfgang Althaus, Milford, Conn.

[73] Assignee: Warner-Lambert Company, Morris Plains, N.J.

[21] Appl. No.: 414,405

[22] Filed: Mar. 31, 1995

[51] Int. Cl.[6] ..... B26B 21/14

[52] U.S. Cl. ..... 30/89; 74/110; 74/520; 403/322

[58] Field of Search ..... 30/87, 89; 74/110, 74/520; 403/68, 322

[56] References Cited

U.S. PATENT DOCUMENTS

| | | | |
|---|---|---|---|
| 1,247,581 | 11/1917 | Seitz | 30/89 |
| 1,639,441 | 8/1927 | Spahr | 30/89 |
| 2,428,961 | 10/1947 | Courney | 74/520 |
| 3,950,848 | 4/1976 | Goldstein | 30/89 |
| 3,964,160 | 6/1976 | Gordon | 30/89 |
| 4,275,498 | 6/1981 | Ciaffone | 30/89 |
| 5,093,991 | 3/1992 | Hendrickson | 30/89 |

*Primary Examiner*—Hwei-Siu Payer
*Attorney, Agent, or Firm*—Charles W. Almer

[57] ABSTRACT

In order to develop a wet razor consisting of a handle, a razor head which can be connected to the front end of the handle, in particular a razor blade unit with at least one razor blade, and a connecting device for connection of the razor head to the handle, to the effect that the results of shaving are improved and the razor can also be used for medical purposes for preoperative shaving, it is proposed that the razor head is mounted so as to be pivotable relative to the handle about a pivot axis located essentially perpendicular to a cutting edge of the razor blade and essentially in the plane of the razor blade.

13 Claims, 2 Drawing Sheets

UNIQUE TWO-AXIS PIVOTING SHAVING SYSTEM

BACKGROUND OF THE INVENTION

The present invention relates to wet razors consisting of a handle, a razor head which can be connected to the front end of the handle, in particular a razor blade unit with at least one razor blade, and a connecting device for connection of the razor head to the handle.

Generic wet razors are known from the state of the art. Generally, a razor head or razor blade unit is formed from a plastic housing and has a blade assembly arranged thereon. In case of a permanent, rigid connection between the handle and the razor head, the head can consist exclusively of a razor blade assembly. If, however, the razor head can be separated from the handle, the head includes both plastic housing elements and a razor blade assembly connected thereto. This razor blade assembly in turn includes single or double razor blades. Generic wet razors as a rule are mass-produced articles which are used for daily shaving, for cosmetic hair removal, or in the medical field.

As it is known that the shape of the body locations to be shaved are irregular, a number of measures have already been proposed in the state of the art to make guiding of the blades relative to the skin to be shaved flexible. Thus pivot joints arranged in the handle region, razor blades which are inserted in razor blade assemblies for movement in the cutting edge plane, and also flexible blades are all known in the art.

In one known system the razor head is arranged pivotably on the holder, with the pivot axis located essentially parallel to the cutting edges, but in front of the razor head. As a result, in addition to considerable pivot movements, uncontrollable moments may occur which can lead to nicks and cuts. In another known system, the pivot axis lies below the razor blade plane, which can lead to the same adverse effects. Finally a system is known in which the razor head in relation to the handle is mounted in a bearing shell, which, apart from long pivot distances and uncontrollable moments, also results in manufacturing drawbacks and drawbacks in operation due to possible contamination and the like. The known systems do of course bring about relative mobility of the razor blades in relation to the skin to be shaved, but cannot ensure that the razor blades actually follow the skin to be shaved, utilising the maximum possible cutting width and retaining the optimum possible cutting angle.

SUMMARY OF THE INVENTION

It is the object of the present invention to develop a wet razor whereby the results of shaving are improved and the razor can also be used for medical purposes such as preoperative shaving. For a technical solution to this object, it is proposed that the razor head is mounted so as to be pivotable relative to the handle about a pivot axis located essentially parallel to a cutting edge of the razor blade and essentially in the plane of the razor blade.

According to the design of the present invention, guiding of the blades very close to the surface to be shaved and optimum following of contours is ensured. Due to the capacity of the razor head to pivot about a pivot axis located parallel to the cutting edge and in the razor blade plane, the blade can also be guided closely along the skin to be shaved at very irregular locations which are difficult to access, so that optimum shaving results are ensured. Slipping can be practically avoided, and movements in the longitudinal direction of the cutting edges can be reduced to a minimum. Advantageously the razor blade assembly can be pivoted in both directions of rotation at an angle of 0° to 80°, preferably at an angle of 5° to 20°. Advantageously it is proposed that the razor head comprises a double razor blade assembly. The ability to pivot according to the invention can easily be combined with conventional working mechanisms, so that, depending on the range of requirements, corresponding shaving results can be obtained.

In a preferred embodiment, it is further proposed that mounting of the razor head can be accomplished only by handle operation, so that the razor head does not have to be gripped.

One possible technical embodiment, according to a preferred embodiment of the invention, includes a connecting device which is formed by a four-bar mechanism, of which one side is pivotable about an axis which is essentially parallel to the pivot axis and intersects with this side of the four-bar mechanism. In this case, a four-bar mechanism is basically a rectangle which is provided with joints at the four corners. If one side of the four-bar mechanism is pivoted in rocker fashion about an axis, then the four-bar mechanism is displaced after the fashion of a parallelogram, so that the side opposite the pivoted side is pivoted in the same direction, this pivoting being about an imaginary axis passing through it. This manner of operation can be used to connect the razor head to the four-bar mechanism, so that a capacity to pivot about the pivot axis located in the plane of the razor blade and extending perpendicular to a cutting edge results automatically.

Advantageously it is proposed that the axis intersects with the side of the four-bar mechanism at right angles. Further advantageously it is proposed that the axis intersects with the side of the four-bar mechanism at the centre. By variations in length of the individual sides of the four-bar mechanism, a number of diverse capacities for pivoting and adaptation to skin contours can be achieved.

In a further preferred embodiment, it is proposed that the sides of the four-bar mechanism are at least partially formed by bar elements. Further it is proposed that the sides of the four-bar mechanism are at least partially formed by plate-like elements. Thus the connecting device of the wet razor according to the invention can be constructed from functional, technical and design viewpoints.

In a still further preferred embodiment, it is proposed that the sides of the four-bar mechanism are adjustable with respect to their length. Further advantageously it is proposed that the sides adjoining the pivoted side of the four-bar mechanism form a mounting device for the razor blade head. With particular advantage these sides may comprise rail-like or hook-like elements. By this measure it is made possible to use conventional, grooved, adequately well-known razor heads which are mounted on the handle by lateral insertion of a rail-like guide. Due to the fact that the rail-like guide is formed on the four-bar mechanism, upon pivoting of the corresponding side of the four-bar mechanism the razor head is also automatically pivoted in the manner according to the invention.

The fastening devices known in the art, in which razor heads are fastened to the handle by means of hook-like elements, already bring about a capacity of the razor head to pivot about the axis formed by the hook-like elements. This pivot capacity can advantageously be complemented by the additional pivot capacity according to the invention, as a result of which the shaving system becomes extremely effective and comfortable.

Advantageously it is proposed that the side of the four-bar mechanism which is pivotable about the axis as well as the side opposite this side comprise at least one bend. By this measure an easy loading and unloading method can be carried out. By an application of appropriate pressure, the two sides buckle in the region of their bends, and the distance between the other two sides of the four-bar mechanism decreases. As these are provided with a mounting device for the razor head, the latter is ejected or the mounting device can be introduced into the corresponding device of the razor head. By this measure the user is prevented from having to touch these heads, which can be a great advantage particularly in the field of medical applications.

Advantageously it is proposed that the four-bar mechanism is spring-loaded in a starting position. If the wet razor according to the invention is guided along a skin contour for the purpose of shaving, the change of contour causes a different pressure on the razor head, so that the pivot process is commenced in order to escape the respective pressure. Due to spring loading, the four-bar mechanism and hence also the razor head duly returns to its starting position.

Furthermore, a connecting device is proposed which can be used to connect a razor head to a handle and may comprise the characteristics described. According to an advantageous proposal of the invention the connecting device is fastened to the razor head. Razor heads of this kind can be provided in appropriate dispensers, so that they can easily be arranged on a handle by means of the connecting device. According to an alternative proposal of the invention the connecting device is fastened to the handle. This measure favours the use of conventional razor blade assemblies, an appropriate mounting device being formed in the region of the four-bar mechanism.

The wet razor according to the invention or the use of the connecting device according to the invention allow improved shaving due to improved following of irregular surfaces to be shaved. The proximity of the cutting edges to the surface to be shaved is similarly improved, as well as optimisation of the cutting angle. Furthermore due to improved following, a greater cutting edge width can be used regularly, which also improves the shaving comfort, as the pressure to be applied to the body to be shaved can easily be controlled. Furthermore this pressure can be further varied by spring-loaded mechanisms. The wet razor according to the invention is extremely ergonomic and delivers excellent shaving results, as compensation by adjustment by the user is avoided.

Further advantages and characteristics of the invention are apparent from the description below with the aid of the figures.

DETAILED DESCRIPTION OF THE INVENTION

Figure 1:
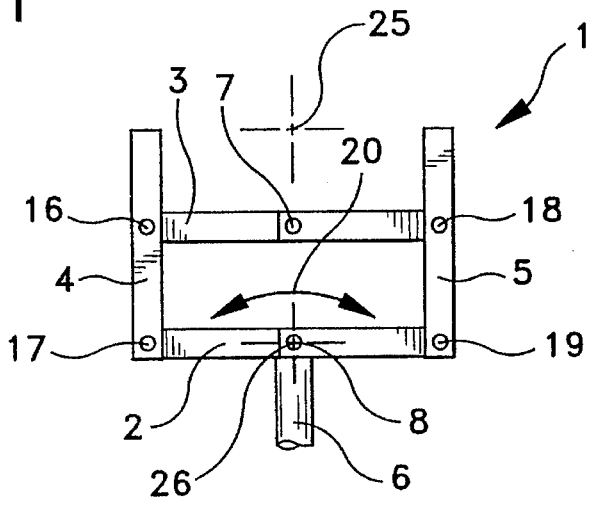
FIG. 1 shows a schematic view of a four-bar mechanism according to the present invention.
Figure 2:
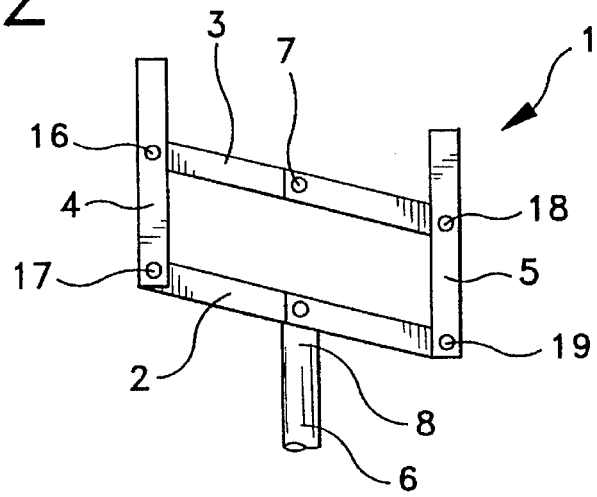
FIG. 2 shows a schematic view of the four-bar mechanism according to FIG. 1 in a pivoted position.
Figure 3:
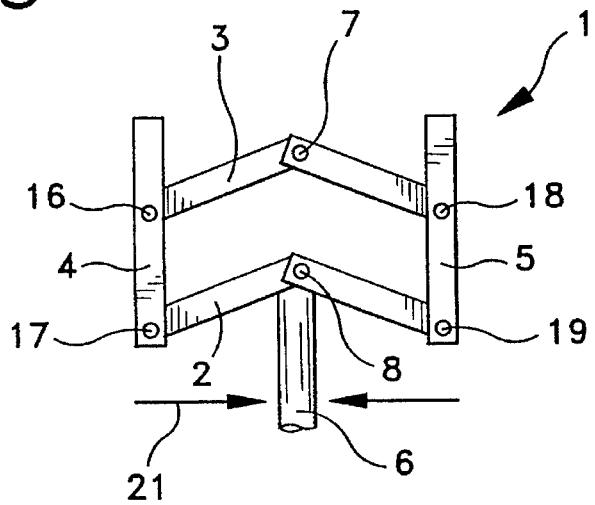
FIG. 3 shows a schematic view of the four-bar mechanism according to FIG. 1 in a buckled position.

The connecting device shown schematically in FIGS. 1 to 3 is in the form of a four-bar mechanism 1 which includes a base side 2, a far side 3 opposite the latter as well as linking sides 4 and 5 which connect sides 2, 3. At the connecting points between the sides 2, 3, 4 and 5 are arranged pivot joints 16, 17, 18 and 19 respectively. The base side 2 is arranged on the handle 6 so as to be pivotable in the direction of the arrow 20 about axis 26, so that pivoting of the base side 2 in the manner shown in FIG. 2 causes parallel reciprocal pivoting of far side 3. A variation in length of individual sides can cause corresponding pivot displacements.

The base side 2 and the far side 3 contain bend points 7, 8 located generally in the midpoint of each side, so that the base side 2 and the far side 3 may buckle allowing sides 4, 5 to move towards each other in the direction of the arrows 21 when the bend points 7 and 8 are buckled. It is also possible to provide the sides 4 and 5 with bend points, so that these can be bent outwards, as a result of which the free-standing ends of the two sides move towards each other.

A razor head may be located at the ends of the sides 4 and 5 opposite pivot points 17, 19. In this location, the razor head can be suitably pivoted about axis 25 in the same manner as sides 2 and 3, the pivot point being located essentially in a razor blade plane.

The longitudinal extent of the four-bar mechanism shown by way of example arises according to requirements. Thus for example four-bar mechanisms spaced apart from each other and consisting of bar elements can be formed along the length of a razor head, and can be connected to each other by rods which can form the pivot joints or a common plate-like base on the base side 2 or side 3, to perform uniform movements. However, it is preferred that a base side 2 of a four-bar mechanism 1 is arranged pivotably relative to the handle.

Figure 4:
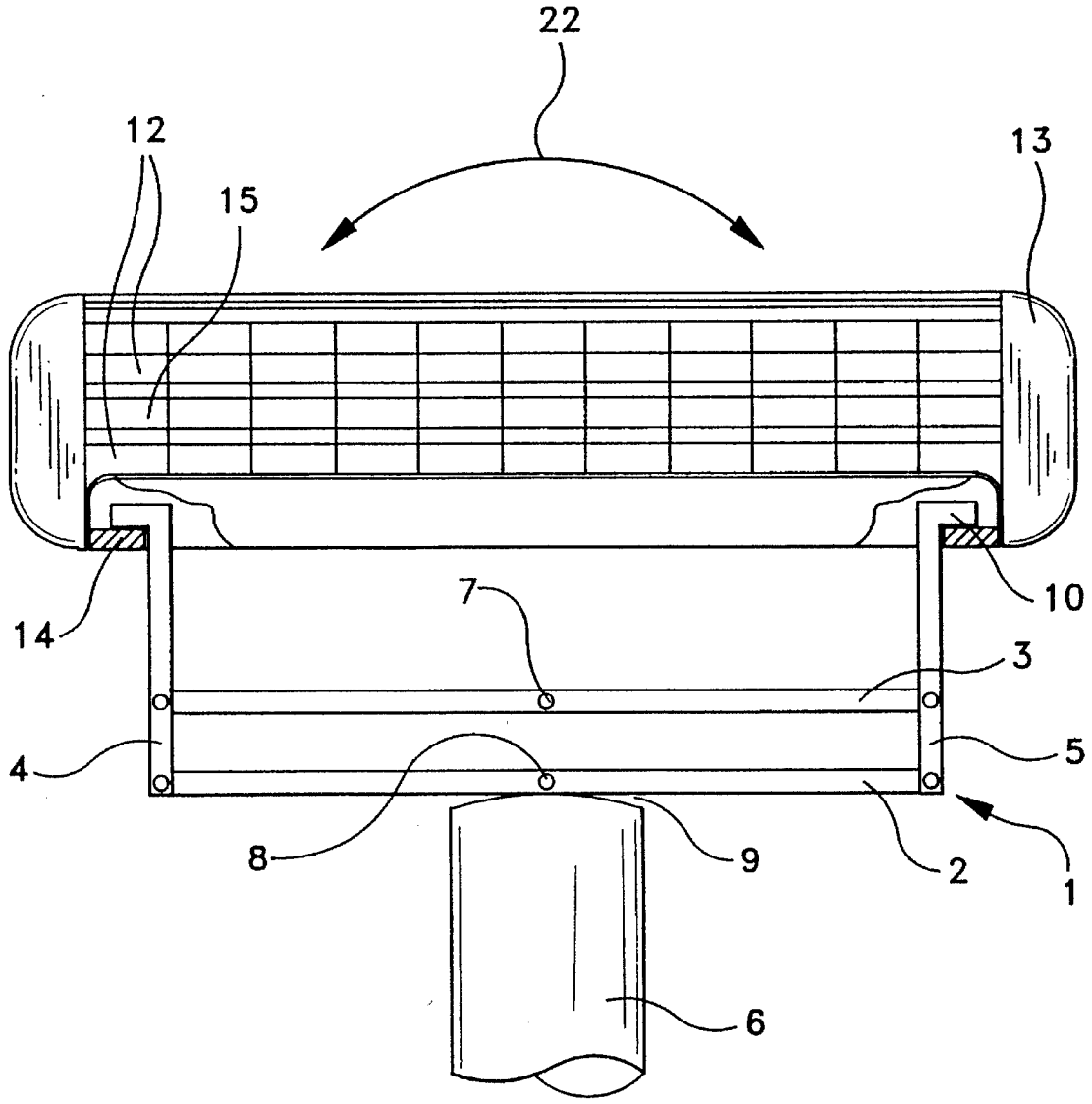
FIG. 4 shows a schematic view of an embodiment of a wet razor.

In the embodiment shown in FIG. 4, the free ends of the sides 4 and 5 of the four-bar mechanism 1 are provided with a rail-guide 10, so that they can be inserted in the latching grooves 14 of a razor head, as a result of which the razor head is fastened pivotably to the handle 6 in the manner described. By simple bending of the sides 2 and 3, sides 4 and 5 will move toward each other and the razor head 11 can be removed from the handle 6. In an alternative embodiment, to allow for bending of the bends 7 and 8, an appropriate operating knob can be provided.

The razor head 11 in the embodiment shown comprises a double razor blade 12 consisting of two single razor blades which are arranged in a housing 13. Between the razor blades is arranged a spacer 15. The double razor blade assembly can in turn be arranged movably in the housing 13, so that different options for movement can be superimposed.

The razor head 11 is pivotable as indicated by the arrow 22. The pivot point is located in the region of the respective razor blade, so that optimum shaving properties result.

While there have been described what are presently believed to be the preferred embodiments of the invention, those skilled in the art will realize that various changes and modifications may be made to the invention without departing from the spirit of the invention, and it is intended to claim all such changes and modifications which fall within the scope of the invention.

I claim:

1. A wet razor comprising a handle, a razor head having at least one razor blade and a connecting device for connection of the razor head to the handle, wherein the razor head is pivotable in two directions relative to the handle about a first pivot axis located essentially perdendicular to a cutting edge of the razor blade and essentially in the plane of the razor blade, and wherein the pivot angle in each of the two directions is between 0 and 80 and the connecting device comprises at least one four-bar mechanism having a base side, a far side and two connecting sides of which the base side is pivotable about a second axis which is essentially parallel to the pivot axis and intersects with the base side of the four-bar mechanism.

2. A wet razor according to claim 1, wherein the pivot angle in each of the two directions is between 5° and 20°.

3. A wet razor according to claim 1, wherein the second axis intersects with the base side at right angles.

4. A wet razor according to claim 3, wherein the second axis intersects with the center of the base side.

5. A wet razor according to claim 3, wherein the sides are at least partially formed by bar elements.

6. A wet razor according to claim 3, wherein the sides are at least partially formed by plate-like elements.

7. A wet razor according to claim 3, wherein at least one side is longitudinally adjustable.

8. A wet razor according to claim 3, wherein the connecting sides comprise a mounting device for the razor head.

9. A wet razor according to claim 8, wherein the mounting device comprises guide rails.

10. A wet razor according to claim 3, wherein bends are located at the midpoints of the base side and the far side of the four-bar mechanism.

11. A wet razor according to claim 10, wherein the razor head is removable from the handle through the application of an inward force on the connecting sides of the four-bar mechanism.

12. A wet razor according to claim 3, wherein the razor head comprises a double razor blade assembly.

13. A connecting device for connection of a razor head to a handle comprising at least one four-bar mechanism having a base side, a far side and two connecting sides, of which the base side is pivotable about an axis which intersects with the base side of the four-bar mechanism.

* * * * *

Adverse Decisions In Interference

Patent No. 5,535,518, Wolfgang Althaus, UNIQUE TWO-AXIS PIVOTING SHAVING SYSTEM, Interference No. 104,158, final judgment adverse to the patentee rendered March 28, 2001, as to claims 1-9, 12 and 13.

*(Official Gazette July 31, 2001)*